US007975515B2

(12) United States Patent
Ygnelzi et al.

(10) Patent No.: US 7,975,515 B2
(45) Date of Patent: Jul. 12, 2011

(54) TAMPER RESISTANT LOCKING DEVICE FOR UNDERGROUND ENCLOSURES AND METHOD

(76) Inventors: Gianni Ygnelzi, Las Vegas, NV (US); Emilio Ygnelzi, Las Vegas, NV (US)

( * ) Notice: Subject to any disclaimer, the term of this patent is extended or adjusted under 35 U.S.C. 154(b) by 280 days.

(21) Appl. No.: 12/061,876

(22) Filed: Apr. 3, 2008

(65) Prior Publication Data

US 2009/0249843 A1 Oct. 8, 2009

(51) Int. Cl.
*B65D 55/14* (2006.01)

(52) U.S. Cl. ..... 70/168; 52/169.6; 70/428; 70/455; 109/52; 109/68; 174/37; 174/67; 174/561; 220/210; 220/254.9; 220/262; 220/324

(58) Field of Classification Search ..... 70/158–173, 70/423–428, 455; 220/210, 324, 262, 254.9, 220/255, 256.1, 259.5, 254.1; 52/20, 169.6; 109/1 R, 1 S, 1 V, 50–52, 68; 174/66, 67, 174/37, 543, 559–563

See application file for complete search history.

(56) References Cited

U.S. PATENT DOCUMENTS

| | | | | | |
|---|---|---|---|---|---|
| 691,093 | A * | 1/1902 | Bagley | 70/161 |
| 1,210,197 | A * | 12/1916 | O'Connor | 220/212.5 |
| 1,400,399 | A * | 12/1921 | Yaeche | 49/465 |
| 1,714,579 | A * | 5/1929 | Werner et al. | 109/68 |
| 1,917,973 | A * | 7/1933 | Hughes | 70/427 |
| 2,022,267 | A * | 11/1935 | Zeek | 220/210 |
| 3,276,835 | A * | 10/1966 | Hall | 312/333 |
| 3,279,838 | A * | 10/1966 | Hamilton | 292/251 |
| 4,113,291 | A * | 9/1978 | Cameron | 292/40 |
| 4,227,388 | A * | 10/1980 | Nigrelli et al. | 70/427 |
| 4,326,395 | A * | 4/1982 | DeRosa | 70/168 |
| 4,408,546 | A * | 10/1983 | Schmidt | 109/75 |
| 4,577,478 | A * | 3/1986 | Economopoulos et al. | 70/168 |
| 5,117,877 | A * | 6/1992 | Sharp | 141/86 |
| 5,916,282 | A * | 6/1999 | Elm et al. | 70/423 |
| 5,966,876 | A * | 10/1999 | Neathery et al. | 52/20 |
| 6,204,446 | B1 * | 3/2001 | Parduhn | 174/45 R |
| 6,668,601 | B1 * | 12/2003 | Reddick | 70/56 |
| 7,174,753 | B2 * | 2/2007 | Gahlhoff et al. | 70/168 |
| 7,347,070 | B1 * | 3/2008 | Spector | 70/169 |
| 7,560,642 | B2 * | 7/2009 | Ygnelzi et al. | 174/45 R |
| 7,723,612 | B2 * | 5/2010 | Butler | 174/45 R |
| D626,686 | S * | 11/2010 | Daidone et al. | D26/155 |
| 7,884,283 | B1 * | 2/2011 | Ousley | 174/45 R |
| 2004/0244444 | A1 * | 12/2004 | Wadsworth | 70/168 |

* cited by examiner

*Primary Examiner* — Lloyd A Gall
(74) *Attorney, Agent, or Firm* — Jeffrey D. Moy; Weiss & Moy, P.C.

(57) ABSTRACT

A locking device is adapted for receipt within the main cavity of an underground enclosure. The locking device includes a container having a main body and a container top which define an interior compartment for holding the items of the underground enclosure. The main body is adapted to be assembled in the main cavity of the underground enclosure and is sized to be retained within the underground enclosure. The container top has a selective open position to allow access to the interior compartment of the main body and a selective closed locked position to deter access thereto. An arm assembly coupled to the container top is moveable between an extended engaged position to retain the container top on the container and a collapsed disengaged position to allow release of the container top from the container. A disengaged unlocked shield slidably engages into the container top and may be locked into an engaged locked position to retain the container top in the selective closed locked position and overlie a release mechanism for the arm assembly.

12 Claims, 15 Drawing Sheets

TAMPER RESISTANT LOCKING DEVICE FOR UNDERGROUND ENCLOSURES AND METHOD

RELATED APPLICATION

This application is related to issued U.S. Pat. No. 7,560,642 filed Oct. 15, 2007 entitled "Tamper Resistant Locking Cap for Utility Poles and Method" by the same named inventor and which is incorporated by reference herein in its entirety.

FIELD OF THE INVENTION

This invention relates generally to a theft prevention device and method. More specifically, this invention relates to a tamper resistant locking device and method for safeguarding electrical wiring and other items in underground enclosures.

BACKGROUND OF THE INVENTION

Metal theft, particularly copper theft but also aluminum, zinc, nickel and bronze theft is a growing problem. As the price for these metals escalates, they have become a target of thieves worldwide. Thieves are risking their lives and others' for metal. Thieves have removed metal wiring and other items from underground enclosures costing utility companies and their customers. Theft is expensive, causes power outages and if live electrical wires are exposed, children, pedestrians and animals could suffer severe injuries or even death. Wire theft is creating a dangerous situation and costing the state and taxpayers thousands of dollars in repair and replacement costs that could be used on a number of other things.

Underground enclosures include, for example, pedestal, vault, handhole and sealed enclosures. Handhole enclosures are grade-level enclosures for use in underground systems, provided with an open or closed bottom and sized to allow personnel to reach into, but not enter, for the purposes of installing, operating, or maintaining equipment or wiring or both in a main cavity of the underground enclosure. Handholes are typically made of non-metallic materials such as precast concrete, polymer concrete, fiberglass, etc. They are typically equipped with a removable lid or cover and lock to allow access through an upwardly open access opening to authorized personnel while providing a measure of security. They may be used in sidewalk, driveway, parking lot, roadway and other installations for telecommunications, CATV, DOT, water meters, utilities, cable, fiber optics and other applications. They are commonly referred to as "utility boxes."

Unfortunately, thieves and vandals have been able to thwart the locks typically used and steal and/or vandalize the items inside the main cavity of the underground enclosures. Attempts to deter such thefts and vandalism have not been entirely successful.

Accordingly, there has been a need for a novel locking device and method which substantially prevent the theft and vandalism of the items inside the underground enclosures. There is also a need for a novel locking device which is of simplified and sturdy construction, easy to install and that is substantially stronger, sturdier, and more secure than prior art locks. The present invention fulfills these needs and provides other related advantages.

SUMMARY OF THE INVENTION

The present invention resides in an improved locking device for an underground enclosure, which substantially deters theft and vandalism of the items inside an underground enclosure. The locking device comprises, generally, a container having a main body and a container top and defining an interior compartment for holding the items, the main body adapted for assembly within a main cavity of an underground enclosure, the container top having a selective open position to allow access to the interior compartment of the container and a selective closed, locked position to deter access thereto; and an arm assembly coupled to the container top moveable being an extended engaged position to selectively retain the container top on the container and a collapsed disengaged position to allow release of the container top from the container; and a shield having an engaged locked position with respect to the container top to selectively retain the container top in the selective closed, locked position and a disengaged unlocked position to allow release of the container top from the container.

The assembled main body may be substantially box-shaped and comprises a pair of substantially parallel end walls and a pair of substantially parallel side walls. The end walls may include side flanges. The upper edge of the side walls and end walls extends into retaining flanges. The lower edge of the side walls and/or the end walls may extend into flanges. Each of the end walls and side walls may be inserted into the underground enclosure, positioned against the walls of the main cavity of the underground enclosure and fastened together to form the substantially box-shaped main body. End portions of the side walls may overlap the opposing side flanges of the end walls. The end walls and/or side walls may include cutouts to permit the passage of wires, etc. therethrough. The end walls and side walls may be fastened together by mounting screws or the like.

When fully assembled within an underground enclosure, the size of the main body is dimensioned to be larger than that of the access opening of the underground enclosure to substantially prevent withdrawal of the main body or locking device therefrom.

The container top comprises a top portion having a top and bottom surface and a substantially square top cutout in substantially the center thereof and a box-like member that extends from the bottom surface of the top portion in substantial vertical alignment with the top cutout to define a substantially central upwardly-open recessed cavity in the container top.

The box-like member of the container top comprises member side walls and a bottom wall spaced apart from and substantially parallel to the top portion of the container top. The length of the top cutout is less than the length of the box-like member. Due to this difference in length, the first and second edges of the top cutout extend over the corresponding edges of the box-like member to form a retaining lip. A plurality of slots may be provided in the bottom wall of the box-like member for engaging with the shield.

The arm assembly comprises a central plate and a plurality of arms being pivotally connected to the central plate. The central plate may be affixed to the bottom surface of the bottom wall of the box-like member and opposing transverse slots may be provided at each end of the central plate. The arms each have a first end portion and a second end portion with each arm pivotally connected at the first end portion to the central plate by a pivot pin. Bolts also provide secondary pivot points to permit movement of the arms around a different axis. The pivot pins are moveable in said opposing transverse slots in the central plate to move the arms between an extended engaged position in which the arms extend substantially perpendicular to the central plate and the second end portions slide under the retaining flanges and a disengaged collapsed position in which said arms slidably disengage from under the retaining flanges. A release knob operatively connected to the arm assembly extends upwardly through a substantially long narrow central slot in the bottom wall of the box-like member and is horizontally moveable therein to move the arm assembly from the extended engaged position to the disengaged collapsed position and vice versa.

The shield comprises a substantially rectangular top wall, and a pair of downwardly-extending shield side flanges having a plurality of substantially L- or J-shaped hooks extending downwardly from edges thereof. The hooks correspond in vertical and lateral spacing with the plurality of slots in the bottom wall of the box-like member.

A cam lock having a keyway, lock core, and a cam fixed to the end of the core opposite the keyway is provided through the top wall of the shield. The keyway faces upwardly to permit access thereto. A key enables the cam to rotate as the key rotates, to engage behind (under) the bottom wall of the box-like member to lock the shield into position in the recessed cavity in a position blocking the release knob.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
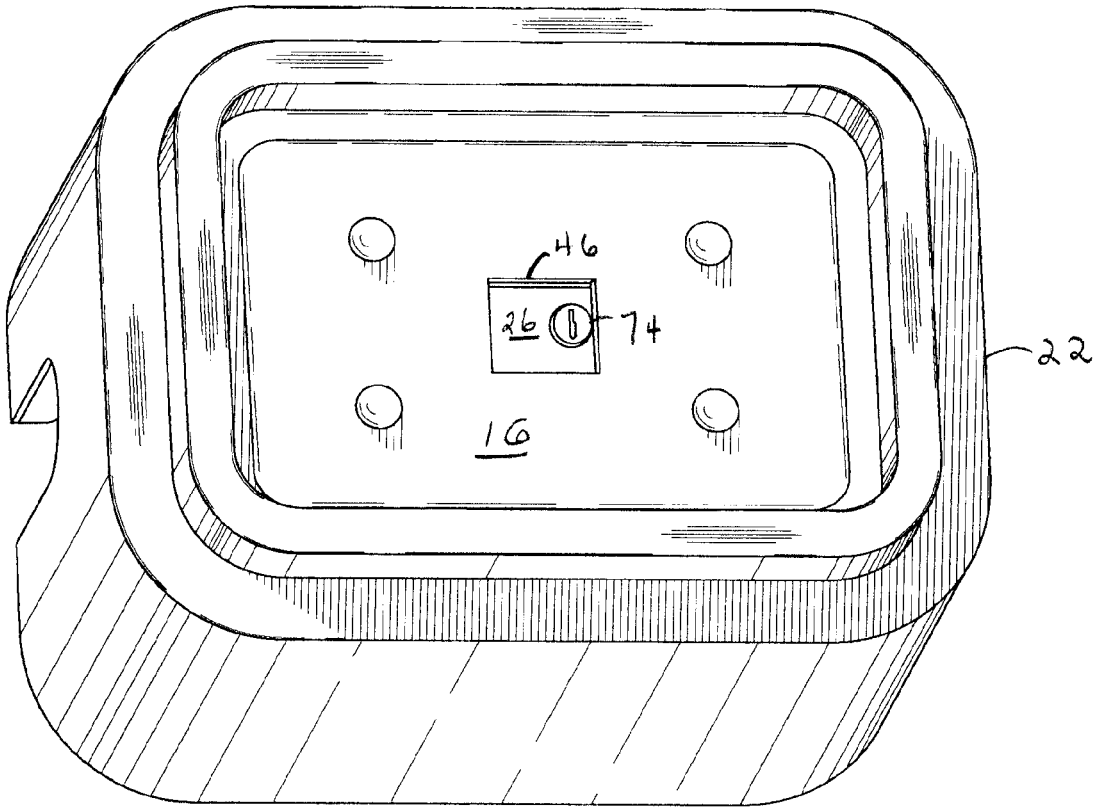
FIG. 1 is a perspective environmental view of an exemplary underground enclosure with the locking device embodying the invention therein, illustrating a container having a main body (not shown) within the exemplary underground enclosure and a container top in a closed locked position over the top of the main body with a shield in an engaged locked position in a recessed cavity of the container top.

As shown in the drawings for purposes of illustration, the present invention is concerned with an improved locking device for an underground enclosure, the locking device generally designated in the accompanying drawings by the reference number 10. The locking device comprises, generally, a container 12 having a main body 14 or 114 and a container top 16 and defining an interior compartment 18 for holding items (not shown), the main body 14 adapted for assembly within a main cavity 20 of an underground enclosure 22 or 122, the container top 16 having a selective open position to allow access to the interior compartment of the container 12 and a selective closed, locked position to deter access thereto; an arm assembly 24 coupled to the container top 16 moveable being an extended engaged position to selectively retain the container top 16 on the container 12 and a collapsed disengaged position to allow release of the container top 16 from the container 12; and a shield 26 having an engaged locked position with respect to the container top 16 to selectively retain the container top 16 in the selective closed, locked position and a disengaged unlocked position to allow release of the container top 16 from the container 12.

In accordance with the present invention, and as illustrated with respect to a preferred embodiment in FIGS. 1 through 20, the improved locking device 10 is configured for safeguarding an underground enclosure from intrusion and substantially reducing theft and damage of its contents, including items such as metal wiring, equipment, etc. As used herein, "underground enclosures" include ground-level pedestal, vault, handhole and sealed enclosures, etc. The underground enclosure typically defines the interior main cavity 20 with an upwardly open access opening 28 (See FIG. 2A). As known in the art, the underground enclosure is typically found already installed at grade level in sidewalks, driveways, parking lots, roadways and other installations.

Figure 2:
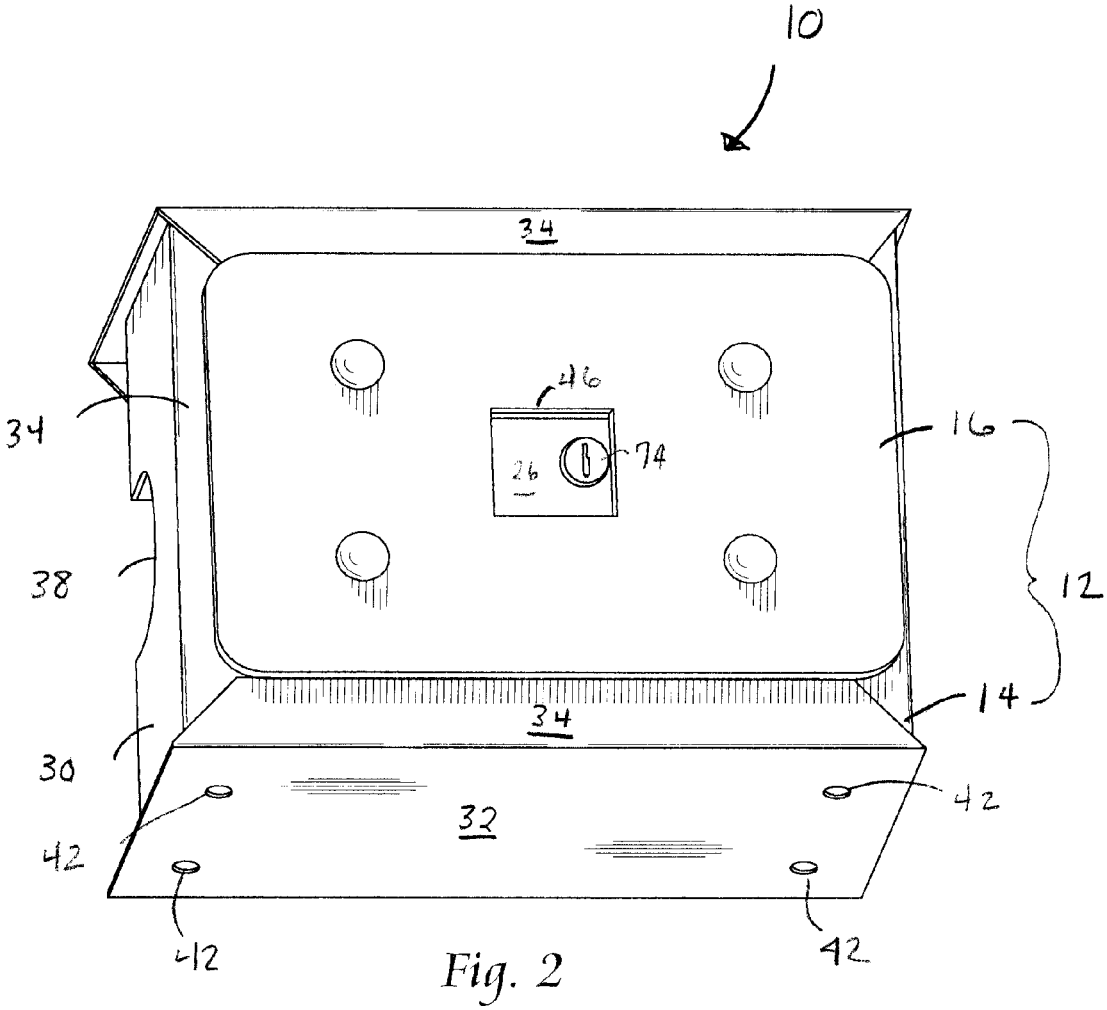
FIG. 2 is a top elevational view of the locking device of FIG. 1.
Figure 2A:
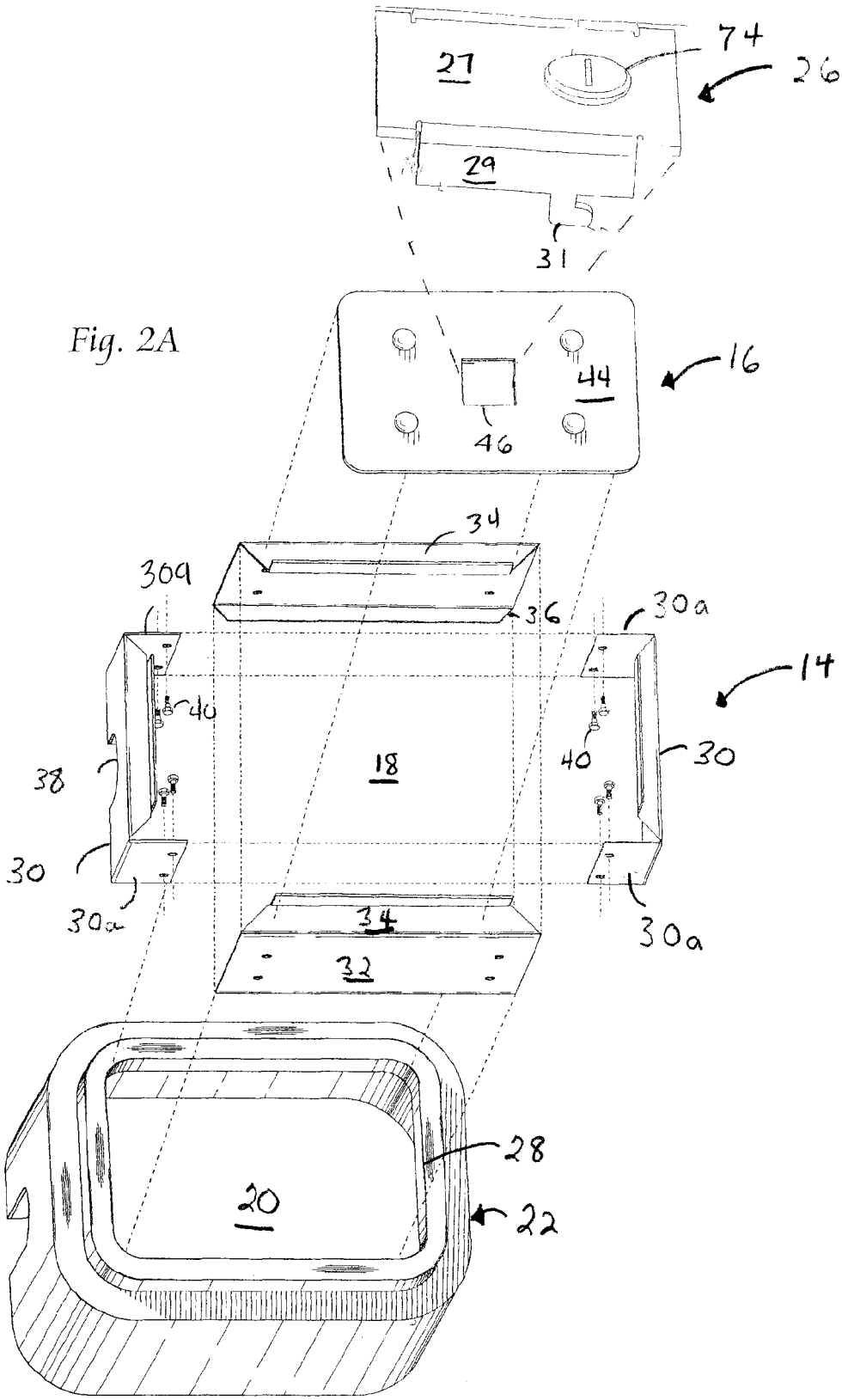
FIG. 2A is an assembly view of the locking device of FIG. 1, illustrating assembly of the container main body inside the exemplary underground enclosure, the positioning of the container top over the open top of the main body, and the shield in a disengaged unlocked position adapted for locking engagement with the container top.
Figure 3:
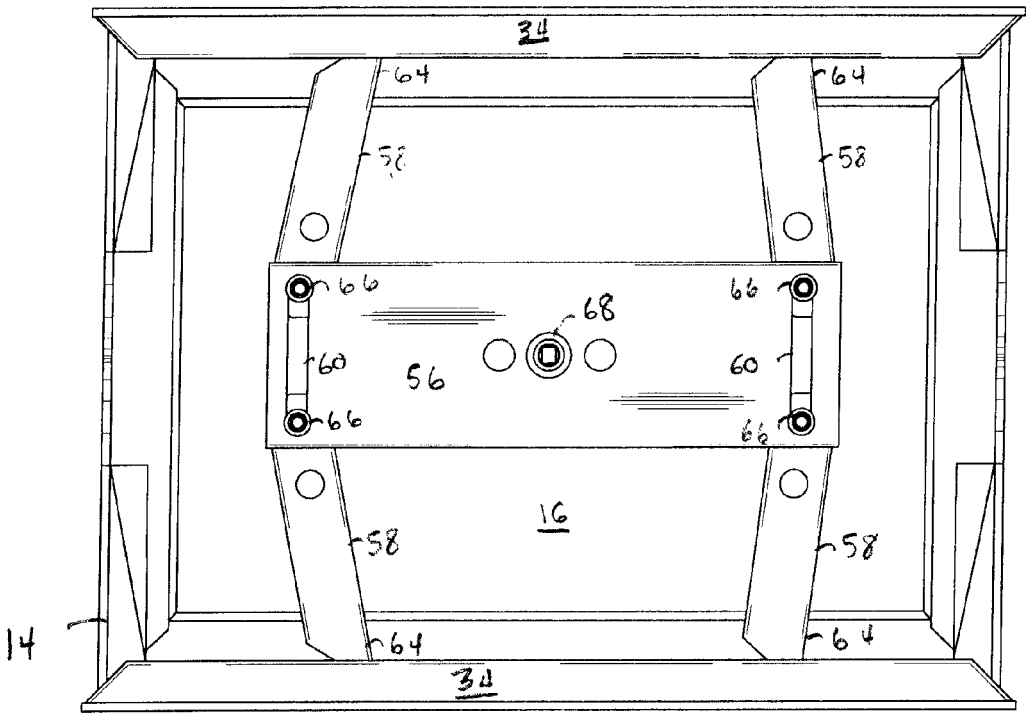
FIG. 3 is a bottom view of the locking device of FIG. 2, illustrating an arm assembly coupled to the bottom surface of the container top in an extended engaged position under the retaining flanges of the main body.

FIG. 1 shows a typical fiberglass underground enclosure 22 with its upwardly open access opening 28 closed by the container top 16 (the open access opening and main body inside the enclosure not shown in FIG. 1). FIGS. 2-10 include one embodiment of a main body adapted for assembly within the exemplary underground enclosure of FIG. 1. As shown in FIGS. 2 and 2A, the substantially box-shaped assembled main body 14 comprises a pair of substantially parallel end walls 30 and a pair of substantially parallel side walls 32. The end walls 30 may include side flanges 30*a* extending at about 90 degrees from the end walls 30. The upper edge of the side walls 32 and end walls 30 extends into inwardly extending substantially L-shaped retaining flanges 34. The lower edge of the side walls 32 and/or the endwalls 30 may extend into inwardly extending flanges 36. Each of the end walls 30 and side walls 32 may be inserted into the underground enclosure 22, positioned against the walls of the main cavity 20 of the underground enclosure and fastened together to form the substantially box-shaped main body 14 with an open top and bottom. End portions of the side walls 32 may overlap the opposing side flanges 30*a* of the end walls 30. The end walls 30 and/or side walls 32 of the main body 14 may include cutouts 38 to permit the passage of wires, etc. therethrough. FIG. 2 shows such a cutout in one of the end walls 30. The end walls 30 and side walls 32 may be fastened together by mounting screws 40 and nuts 41 or the like. The heads of the mounting screws 40 may be accessed from the interior compartment 18 to permit disassembly of the main body 14 and removal from the underground enclosure 22 if necessary. The mounting screws 40 may extend through complementary openings 42 in the end wall side flanges 30*a* and side walls 32. The mounting screws 40 may be welded in place and secured by a nut.

Figure 11:
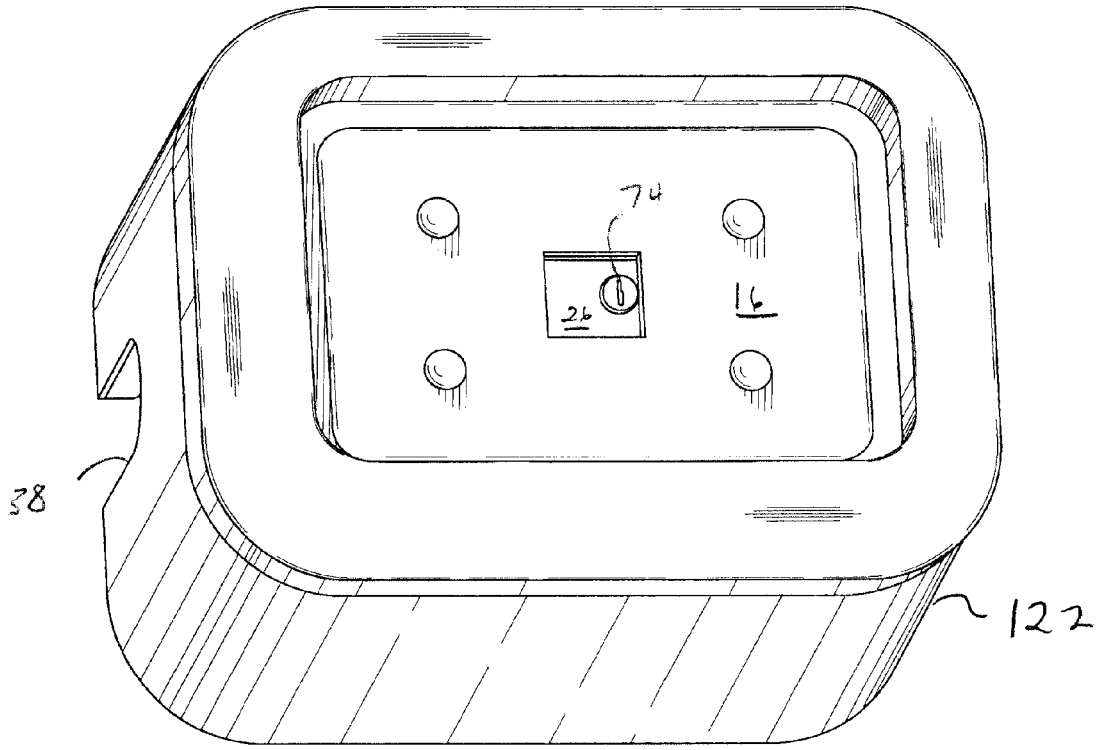
FIG. 11 is a perspective environmental view of another exemplary underground enclosure with the locking device embodying the invention therein, illustrating a container having a main body (not shown) within the exemplary underground enclosure and the container top in a closed locked position over the top of the main body with the shield in an engaged locked position in a recessed cavity of the container top.
Figure 12:
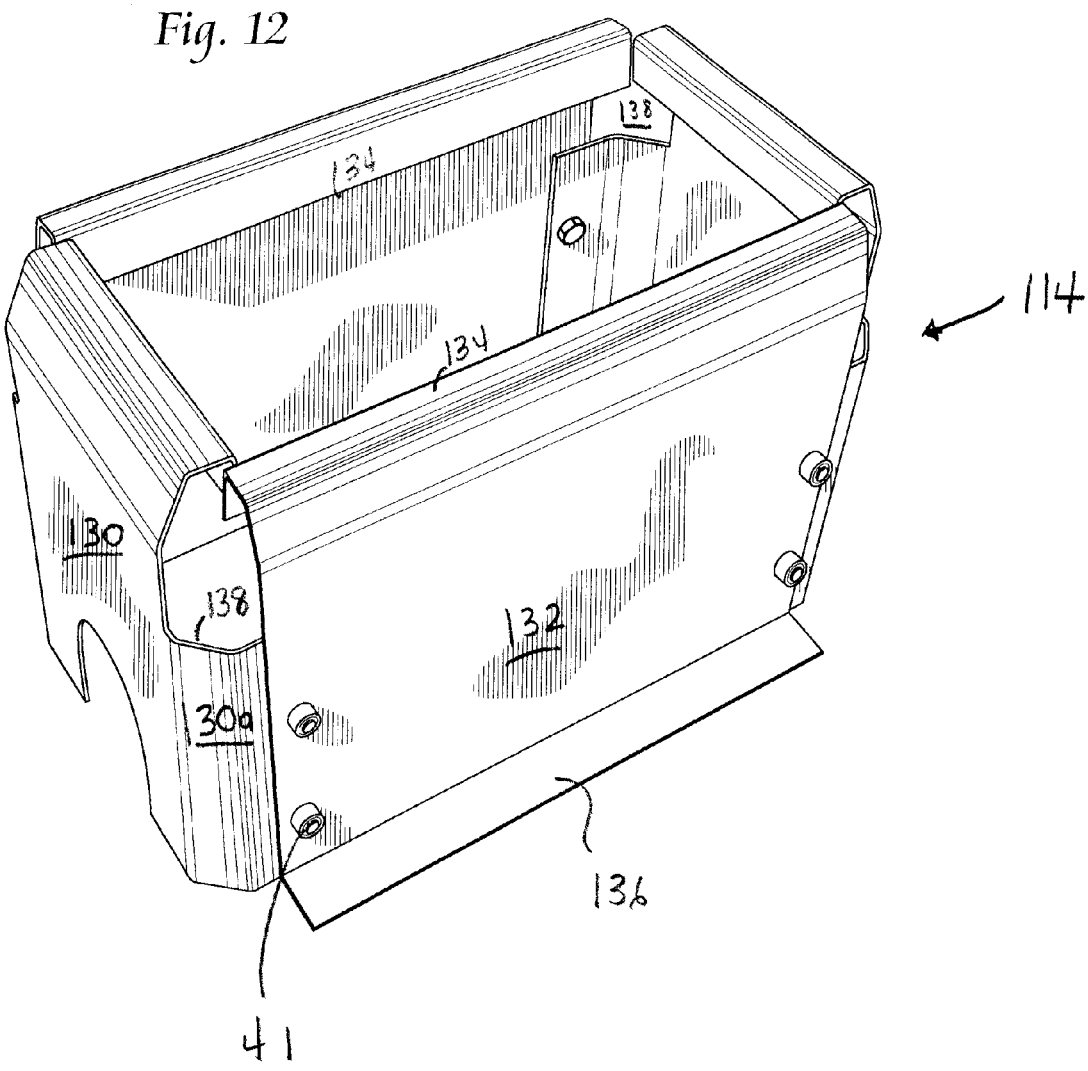
FIG. 12 is a perspective view of another embodiment of the main body of the container of FIG. 11, illustrating the container top removed therefrom.
Figure 13:
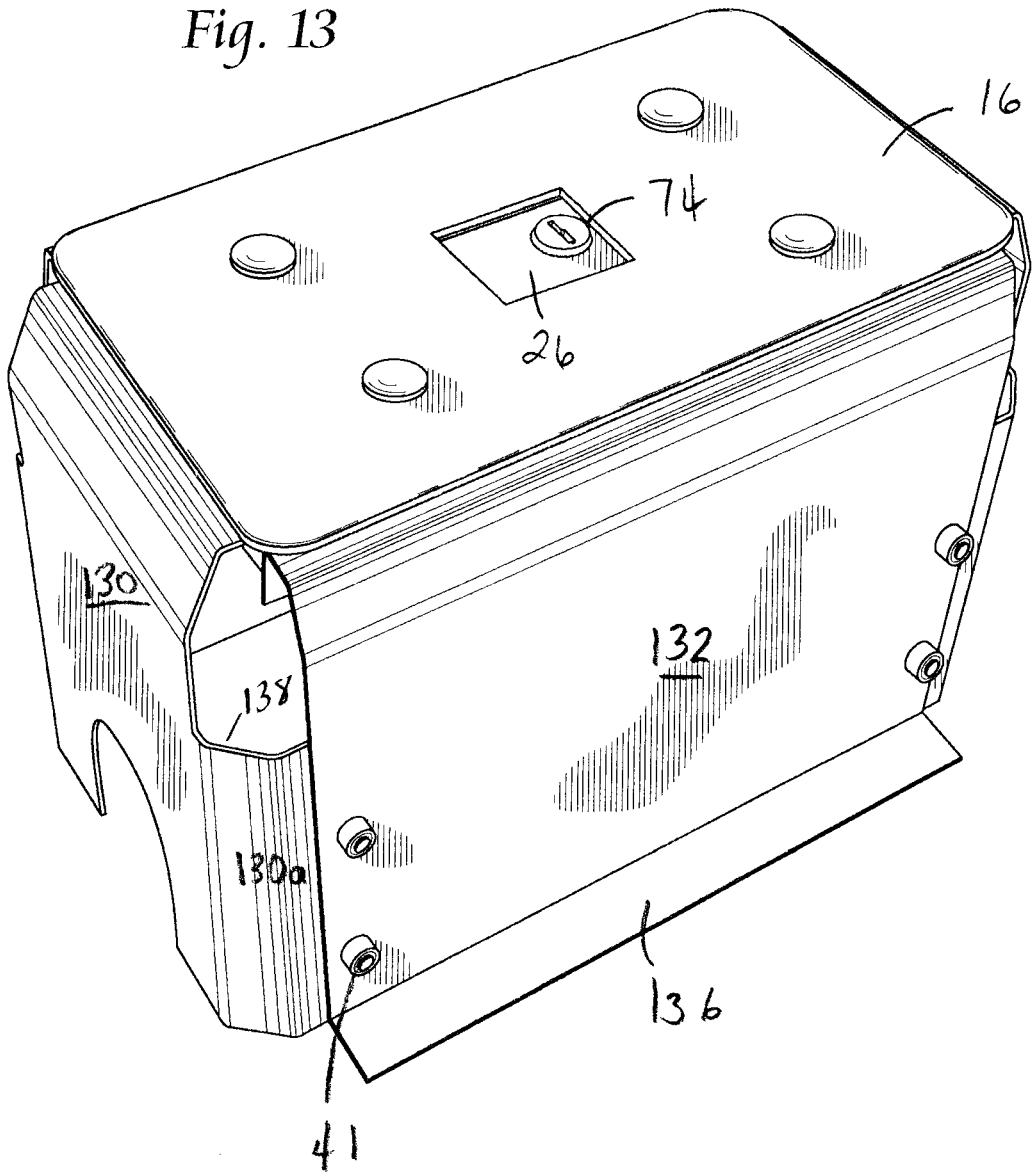
FIG. 13 is a perspective view of the locking device of FIG. 11.
Figure 14:
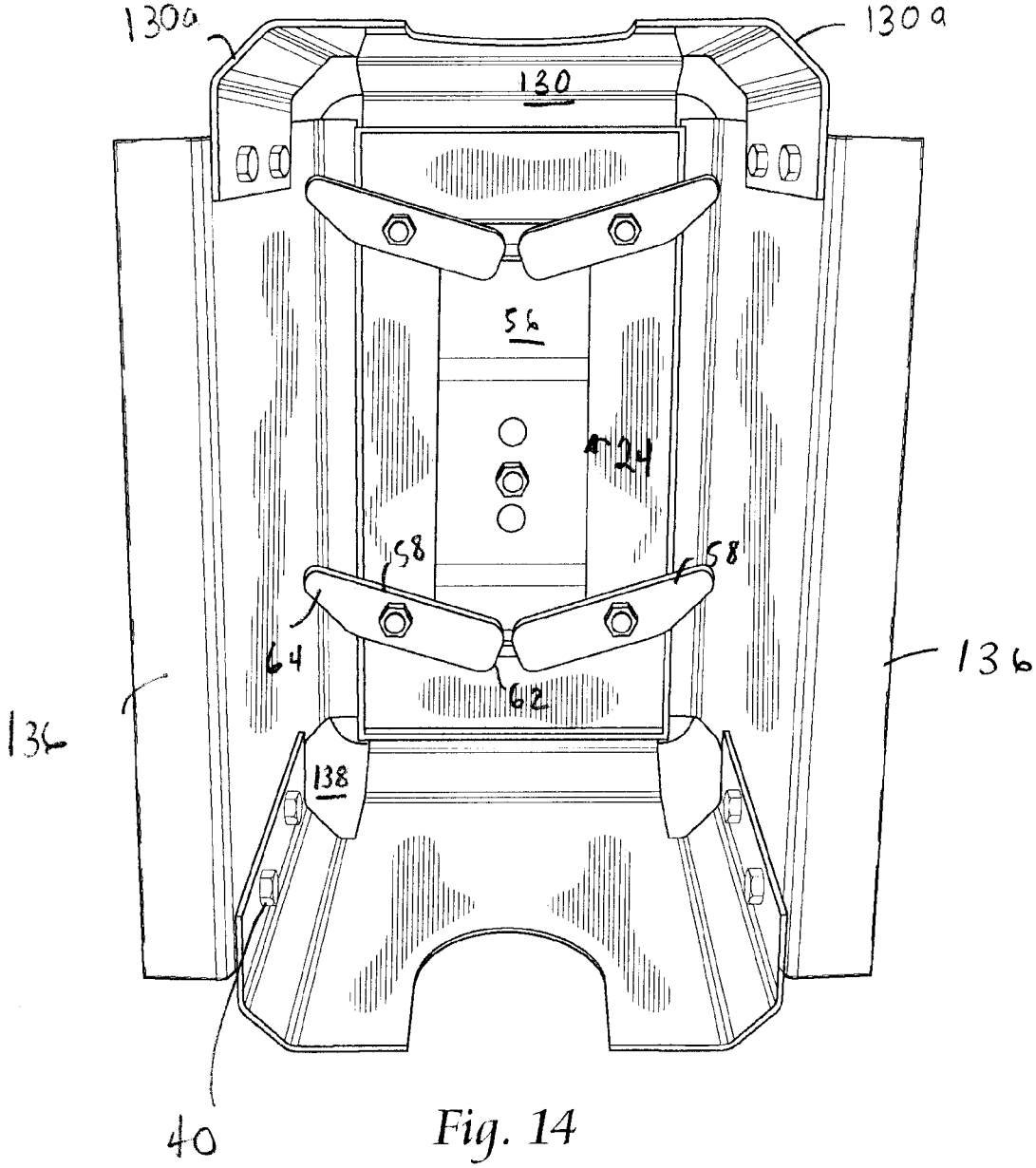
FIG. 14 is a bottom view of the locking device of FIG. 13, illustrating the arm assembly in an extended engaged position.

FIG. 11 shows a typical concrete underground enclosure 122. FIGS. 12-14 include another embodiment of a substantially box-shaped main body 114 adapted for assembly within the exemplary underground enclosure 122 of FIG. 11. The main body 114 comprises a pair of substantially parallel end walls 130 and a pair of substantially parallel side walls 132 (See FIG. 12). As shown in FIG. 12, the end walls 130 may include side flanges 130*a* that may be at about a 45 degree angle from the end walls 130. The upper edge of the side walls 132 and end walls 130 extends into inwardly extending downwardly turning substantially U-shaped retaining flanges 134. The lower edge of the side walls 132 may extend into outwardly extending lower flanges 136 (See FIG. 12). End portions of the side walls 132 may overlap the opposing side flanges 130*a* of the end walls 130 as shown in FIGS. 12 and 13. The end walls 130 and/or side walls 132 of the main body 114 may include corner cutouts 138 and other cutouts to permit the passage of wires, etc. therethrough. FIG. 12 shows such corner cutouts. Each of the end walls 130 and side walls 132 may be inserted into the underground enclosure 122, positioned against the walls of the main cavity 20 of the underground enclosure and fastened together in the same manner as main body 14 to form the substantially box-shaped main body 114 with an open top and bottom.

When fully assembled within an underground enclosure, the size of the main body is dimensioned to be larger than that of the access opening of the underground enclosure to substantially prevent withdrawal of the main body or locking device therefrom i.e. the main body is sized or dimensioned to be retained inside the underground enclosure once assembled thus substantially preventing a thief from lifting the entire assembled main body or locking device out of the underground enclosure. While a main body has been described having an open bottom, in four separate pieces, and with end wall side flanges, substantial benefit may be achieved by other configurations such as a main body having a closed bottom and/or assembled from one or more pieces and/or with the side flanges on the side walls, as well as having other configurations. In addition, the main body may be configured in other than a substantially box-like shape to correspond with other shapes of underground enclosures. It is also to be appreciated that while main body 14 is shown for use with underground enclosure 22 and main body 114 with underground enclosure 122, main body 114 may be used in underground enclosure 22 and main body 14 may be used in underground enclosure 122.

Figure 4:
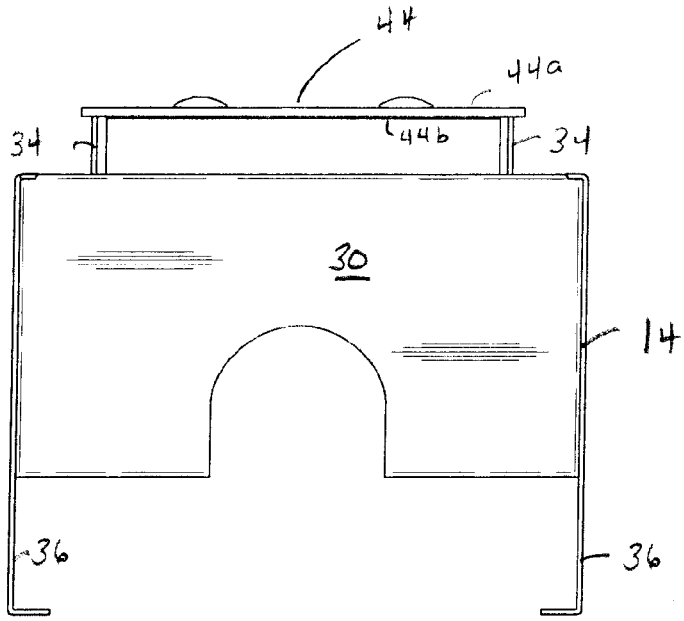
FIG. 4 is an end view of the locking device container, illustrating the main body with the container top in a closed locked position over the open top of the main body (the underground enclosure not shown)
Figure 5:
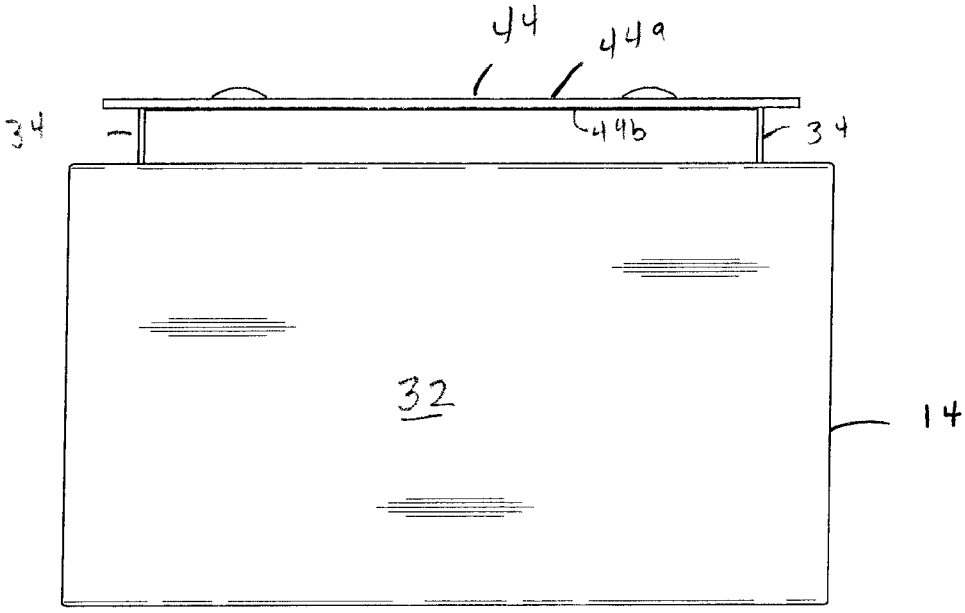
FIG. 5 is a side view of the container of FIG. 4.

As shown in FIGS. 4 and 5, the container top 16 comprises a top portion 44 having a top and bottom surface 44*a* and 44*b* and a substantially square top cutout 46 (See FIG. 2) in substantially the center thereof and a box-like member 48 that extends from the bottom surface of the top portion 44 in substantial vertical alignment with the top cutout 46 to define a substantially central upwardly-open recessed cavity in the container top 16. The container top may be a removable container top. The thickness of the top portion 44 should be such that the top surface 44*a* of the top portion is substantially flush or lower than grade-level so as to not pose a tripping hazard. The container top 16 has a first end and a second end. The top portion 44 is dimensioned to cover the open top of the container main body 14 or 114.

Figure 6:
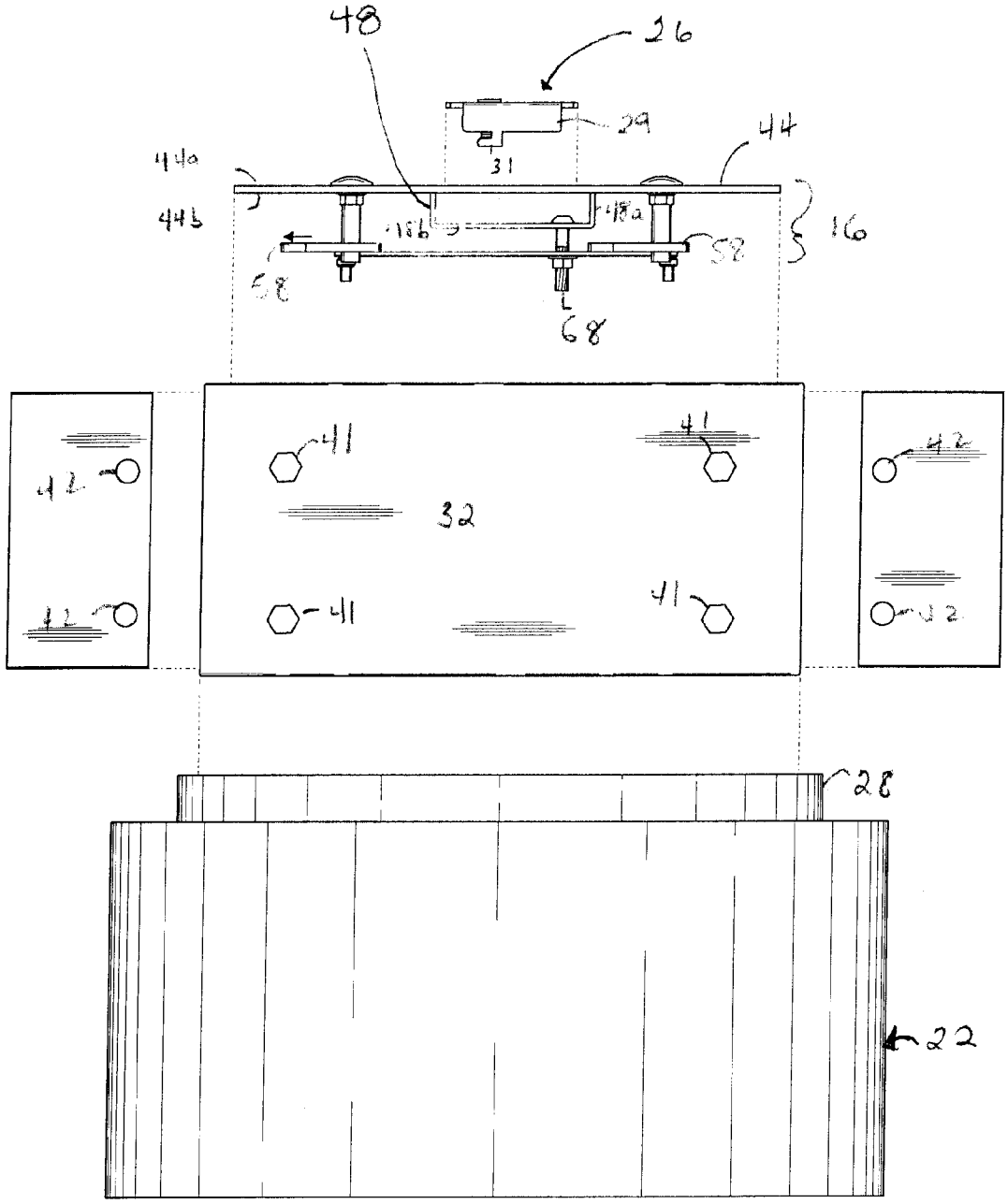
FIG. 6 is another assembly view similar to FIG. 2A, illustrating the manner in which the end walls and side walls are adapted for assembly to form a main body within the exemplary underground enclosure, the main body larger than the access opening of the underground enclosure with the container top adapted for closing the open top of the main body and the shield adapted for locking engagement with the container top.
Figure 7:
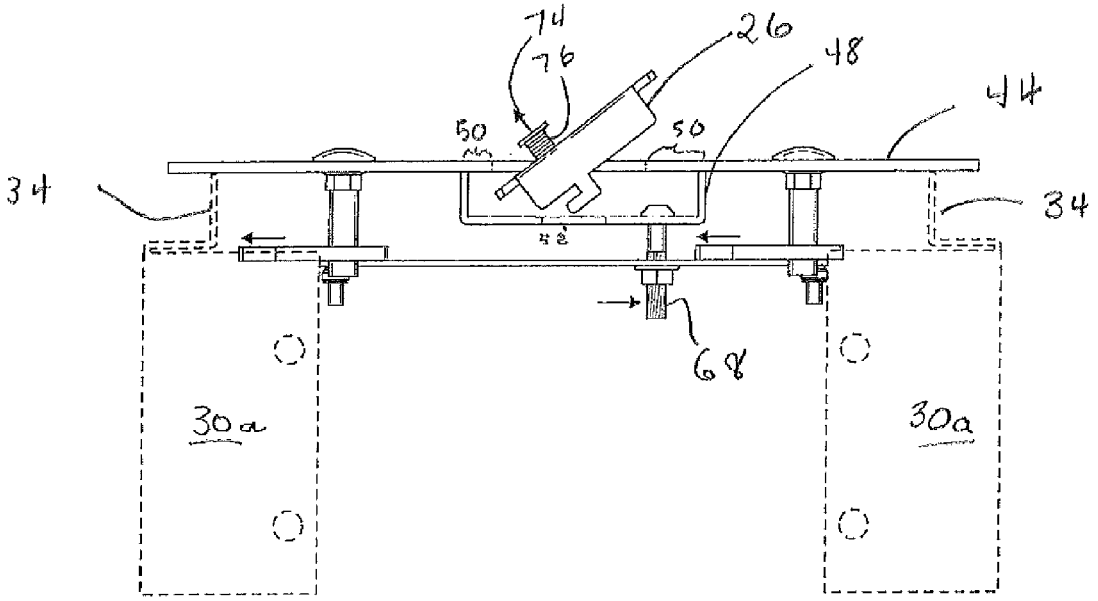
FIG. 7 is a side view of the locking device, illustrating the manner in which a first end of the shield in a disengaged unlocked position is inserted into a recessed cavity in the container top of the locking device with the side and retaining flanges of the container main body shown in dotted lines.
Figure 8:
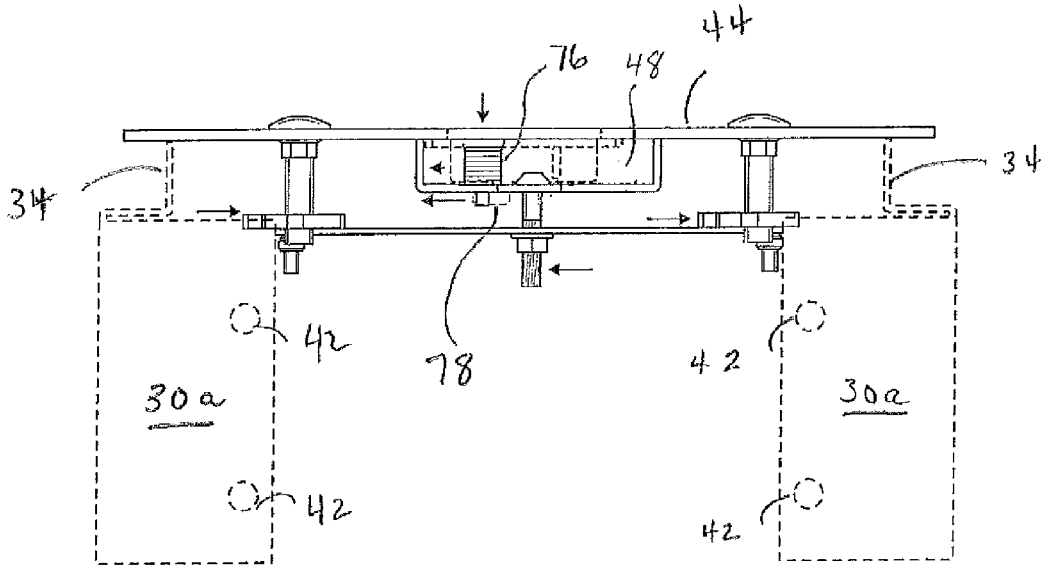
FIG. 8 is another side view of the locking device similar to FIG. 7, illustrating the shield in an engaged locked position with respect to the container top.
Figure 9:
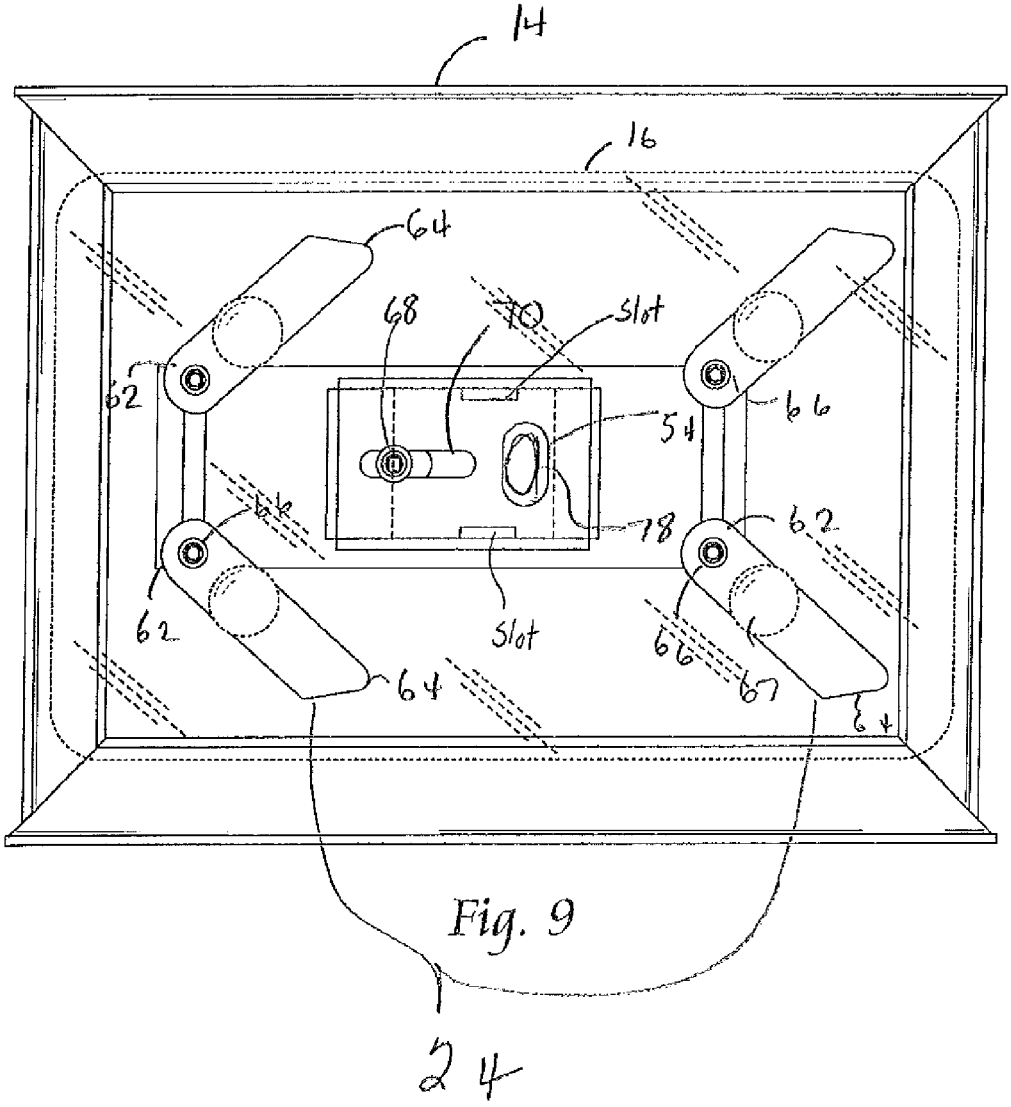
FIG. 9 is a bottom view of the locking device, illustrating the arm assembly in a collapsed disengaged position and the shield in the disengaged unlocked position.

As shown in FIGS. 6-8, the box-like member 48 of the container top comprises member side walls 48*a* and a bottom wall 48*b* spaced apart from and substantially parallel to the top portion 44 of the container top 16. The length of the top cutout 46 is less than the length of the box-like member 48. Due to this difference in length, the first and second edges of the top cutout 46 extend over the corresponding edges of the box-like member 48 to form a retaining lip 50 for purposes as described hereinafter. A plurality of slots 52 may be provided in the bottom wall 48*b* of the box-like member 48 for engaging with the shield 26 as hereinafter described. A pair of opposing slots is shown in FIG. 9. A lock opening 54 is also provided in the bottom wall of the box-like member for purposes as hereinafter described.

Figure 10:
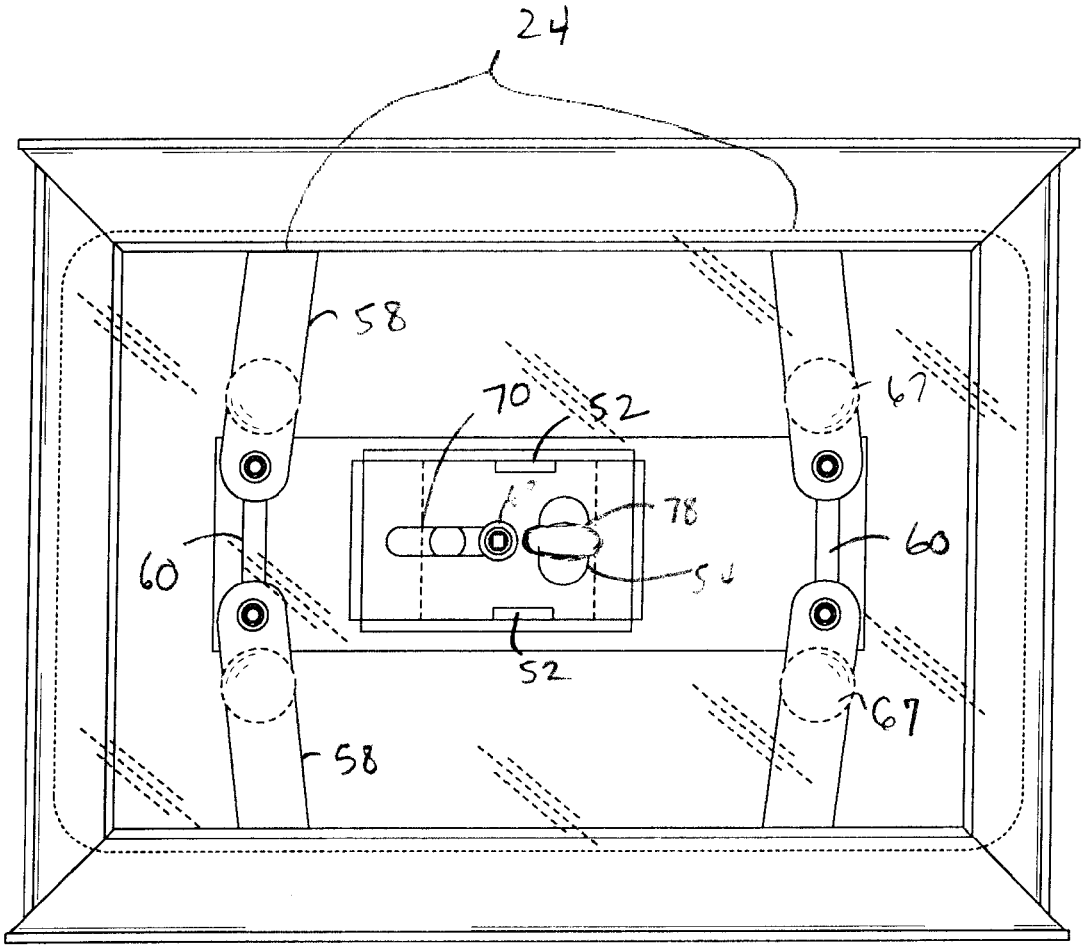
FIG. 10 is another bottom view of the locking device of FIG. 9, illustrating the arm assembly in an extended engaged position under the retaining flanges of the container main body and the shield in an engaged locked position.

As shown in FIGS. 9 and 10, the arm assembly 24 comprises a central plate 56 and a plurality of arms 58 being pivotally connected to the central plate. The central plate may be affixed to the lower surface of the bottom wall of the box-like member 48 and opposing transverse slots 60 may be provided at each end of the central plate. FIG. 9 shows two pairs of arms each having a radial first end portion 62 and a second end portion 64 with each arm pivotally connected at the first end portion 62 to the central plate 56 by a pivot pin 66. The pivot pins are moveable in said opposing transverse slots in the central plate. Bolts 67 provide a secondary pivot point for the arms. The arms move in an arm plane between an extended engaged position in which the arms extend substantially perpendicular to the central plate and the second end portions slide under the retaining flanges 34 or 134 (FIG. 10) and a disengaged collapsed position in which said arms slidably disengage from under the retaining flanges 34 or 134 (FIG. 9). A release knob 68 operatively connected to the arm assembly extends upwardly through a substantially long narrow central slot 70 in the bottom wall of the box-like member 48 and is horizontally moveable therein to move the arm assembly 24 from the extended engaged position (FIG. 10) to selectively retain the container top 16 on the container 12 and the disengaged collapsed position (FIG. 9) to allow release of the container top 16 from the container 12. The release knob 68 and substantially long narrow slot 70 are collectively hereinafter referred to as the "release mechanism."

As shown in FIGS. 2A and 15-17, the shield 26 comprises a substantially rectangular top wall 27, and a pair of downwardly-extending shield side flanges 29 having a plurality of substantially L- or J-shaped hooks 31 extending downwardly from edges thereof. The hooks correspond in vertical and lateral spacing with the plurality of slots 52 in the bottom wall 48*b* of the box-like member 48. A pair of hooks is shown in FIG. 6. It is to be appreciated that more hooks may be used with a corresponding increase in the number of slots in the box-like member 48. The top wall of the shield 26 is dimensioned to be slightly longer than the top cutout 46 but not to exceed the length of the box-like member 48.

Figure 17:
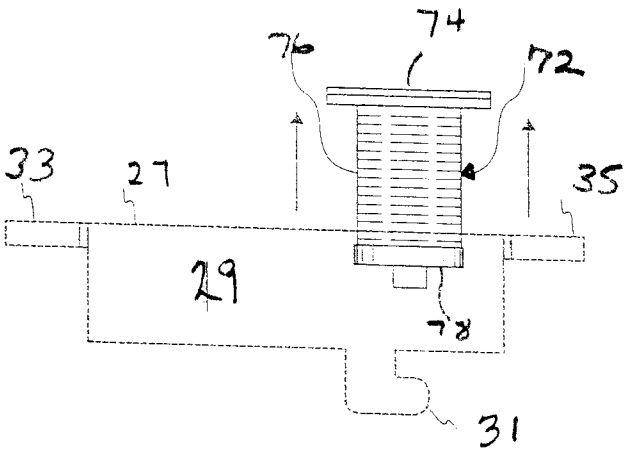
FIG. 17 is another side view of the shield of FIG. 15, illustrating the cam lock in an unlocked position.
Figure 16:
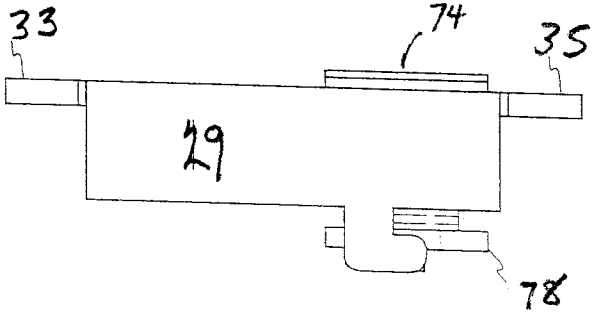
FIG. 16 is a side view of the shield of FIG. 15, illustrating the cam lock in a locked position.
Figure 15:
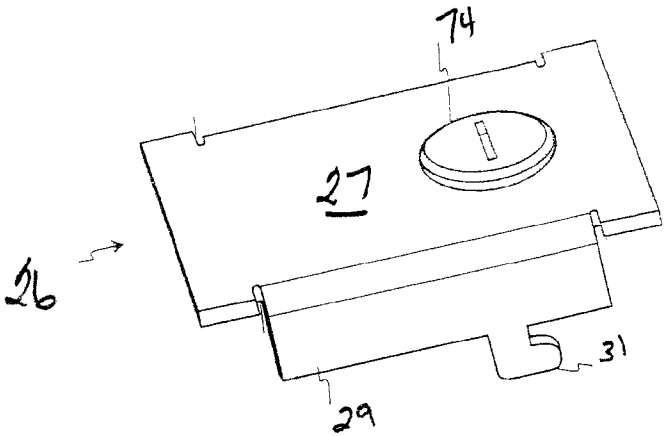
FIG. 15 is a perspective view of the shield.
Figure 20:
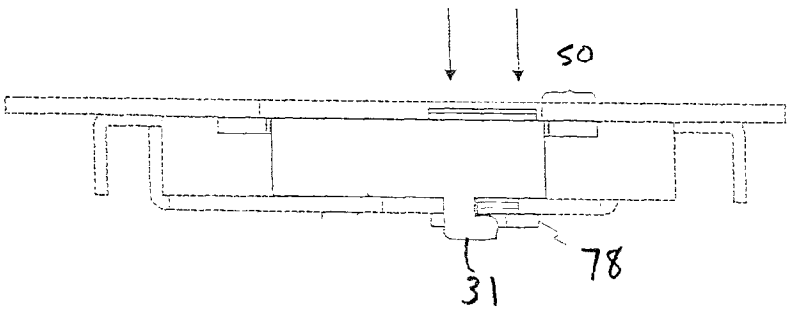
FIG. 20 is another operational view of the shield in an engaged locked position with respect to the container top with a cam of the cam lock under the rear wall of the box-like member.

As shown in FIGS. 15-20, a cam lock 72 having a keyway 74, lock core 76 and a cam 78 fixed to the core is provided through a shield lock opening (not shown) in the top wall of the shield 26. The keyway faces upwardly to permit access thereto. A key (not shown) enables the cam to rotate as the key rotates, usually through 90° to engage under the bottom wall 48*b* of the box-like member 48 to lock the shield 26 into position in the recessed cavity as shown in FIGS. 1, 8 and 11. The core is moveable vertically in the substantially aligned lock openings in the bottom wall of the box-like member and the shield between a substantially flush locked position (See, e.gs. FIGS. 1, 11, and 15-16) and an upwardly extended unlocked position (FIG. 17).

Figure 19:
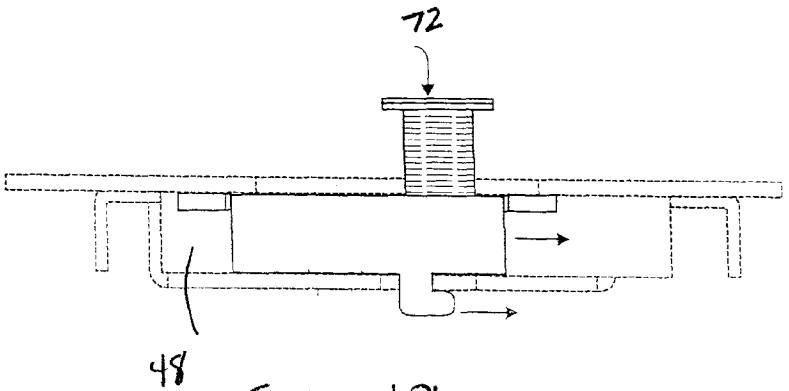
FIG. 19 is a further operational view of the shield in an engaged position with respect to the container top, illustrating the cam lock still in an unlocked position.
Figure 18:
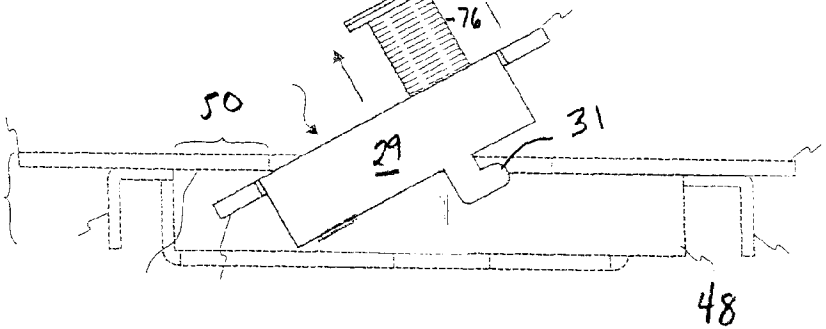
FIG. 18 is a side operational view of the shield in a disengaged unlocked position with respect to the container top, illustrating the manner in which a first end of the shield is inserted into the recessed cavity of the container top with the cam lock in an upwardly extended unlocked position.

In use, with the arm assembly 24 in a collapsed disengaged position, the container top 16 is placed over the open top of the main body 14 or 114 (which has already been assembled within the underground enclosure) to close the container 12. The arm assembly 24 is then moved to the engaged, extended position (e.g. FIGS. 3 and 10) by sliding the release knob to retain the container top 16 on the container 12. Shield 26 is then positioned within the recessed cavity by orienting a first end 33 of the shield 26 with the first end of the container top 16 (FIG. 18). The first end of the shield 26 is inserted into the recessed cavity and the shield 26 slid horizontally toward the first end of the shield 26 until a second end 35 of the shield clears the second edge of the top cutout 46. The pair of hooks slidably engages into the slots in the box-like member 48 and the shield slid laterally toward the second end of the container top 16 with the top surface of the shield at the first and second ends 33 and 35 substantially flush against the bottom surface of the top portion 44 of the container top 16 with the retaining lip over the first and second ends of the shield (FIG. 19). When the cam is under the bottom wall of the box-like member 48, the key (not shown) is then turned in the keyway pivoting the cam to a substantially perpendicular position with respect to the lock opening to lock the shield 26 into the engaged locked position (FIG. 20) in the container top 16 in a position over the release mechanism (FIG. 10) to substantially prevent the thief and/or vandal from moving the arm assembly 24 to the collapsed disengaged position thus preventing release of the container top 16 from the container 12. This arrangement thus retains the container top 16 in the selective closed, locked position to deter access to the interior compartment 18 of the container 12 to safeguard items therein.

Access to the main cavity 20 of the underground enclosure 22 may however be necessary. An authorized user could turn the key in the keyway to pivot the cam to a position parallel to the lock openings and move the lock core into an upward position. The shield 26 can then be slid horizontally to the disengaged locked position to disengage the hooks and permit withdrawal of the shield 26 from behind the retaining lip at the second edge of the top cutout 46 and then slid to withdraw the first end of the shield 26 from behind the retaining lip at the first edge of the top cutout 46. The shield 26 may then be removed from the recessed cavity thus exposing the release mechanism. The arm assembly 24 may be moved to the collapsed disengaged position by sliding the release knob in the opposite direction to allow release of the container top 16 from the container 12 thus allowing access to the interior compartment 18 of the container and its contents.

From the foregoing, it is to be appreciated that when the locking device is in the main cavity 20 of the underground enclosure 22, the usual items of the underground enclosure may be safely and securely retained with the interior compartment 18 of the main body 14. The locking device of this invention greatly reduces the probability of theft and vandalism to the items within underground enclosures by substantially preventing access thereto. In addition, the locking device of this invention substantially prevents access to the release mechanism used to retain and allow release of the container top 16 from the main body 14 of the container 12. The locking device is preferably made from a strong and resilient material such as a metal alloy or the like, preferably carbon steel or stainless steel to substantially prevent the locking device from rusting and from breach by tools or the like.

Although a particular embodiment of the invention has been described in detail for purposes of illustration, various modifications may be made without departing from the spirit and scope of the invention. Accordingly, the invention is not to be limited, except as by the appended claims.

We claim:

1. A locking device for an underground enclosure, comprising:

a container having a main body and a container top defining an interior compartment for holding items, the main body of the container adapted for assembly within a main cavity of an underground enclosure, the container top having an enclosure formed on a bottom surface thereof, an opening formed through the container top allowing access to an interior of the enclosure, the container top having a selective open position to allow access to the interior compartment of the container and a selective closed locked position to deter access thereto;

an arm assembly coupled to the container top moveable being an extended engaged position to selectively retain the container top on the container and a collapsed disengaged position to allow release of the container top from the container, wherein a slot formed through a bottom surface of the enclosure allows for moving the arm assembly to and from the engaged position and disengaged position; and a shield, wherein the shield is slidable into the opening and positionable within the enclosure, hooks on the shield engaging slots formed through the enclosure, a locking device on the shield engaging a bottom surface of the enclosure to form an engaged locked position with respect to the container top to selectively retain the container top in the selective closed locked position and the locking device on the shield disengaging the bottom surface of the enclosure to form a disengaged unlocked position to allow release of the container top from the container.

2. The locking device of claim 1 wherein the main body of the container is sized to be retained within a main cavity of the underground enclosure.

3. The locking device of claim 2 wherein both a pair of end walls and a pair of side walls having inwardly-extending retaining flanges along an upper edge thereof form the main body being substantially box-shaped.

4. The locking device of claim 3 wherein cutouts are defined in at least one of the side walls and at least one of the end walls.

5. The locking device of claim 1 wherein the arm assembly is coupled to a bottom wall of the enclosure and comprises a central plate and a plurality of arms each having a first end portion pivotally connected to the central plate and a second end portion that slidably engages under retaining flanges of the main body when the container top is in the selective closed locked position and disengages therefrom when the container top is in the selective open position.

6. The locking device of claim 5 wherein the shield comprises a top wall having a cam lock therethrough and joined to a pair of side flanges having a plurality of hooks extending downwardly therefrom, the shield in an engaged locked position when the plurality of hooks are slidably engaged into a plurality of slots in the bottom wall of the enclosure and the shield is fully received in the enclosure with the cam lock in a locked position.

7. The locking device of claim 6 wherein the shield in the engaged locked position covers a release mechanism and in the disengaged unlocked position provides access to the release mechanism.

8. The locking device of claim 7 wherein the plurality of hooks correspond in lateral spacing and in vertical spacing to the positioning of the plurality of slots in the bottom wall of the enclosure.

9. A locking device for an underground enclosure comprising:

a main body adapted to be assembled in the underground enclosure and defining a upwardly open interior compartment;

a container top adapted to cover the upwardly open interior compartment and having an arm assembly coupled thereto moveable by a release mechanism between an extended engaged position to selectively retain the container top in a selective closed locked position over the upwardly open interior compartment and a collapsed disengaged position to allow release of the container top to allow access to the upwardly open interior compartment; and a shield adapted for slidable locking engagement into a recessed cavity in the container top in a position substantially preventing access to the release mechanism and retaining the container top in the selective closed, locked position;

wherein the container top has a top portion with a top surface and a bottom surface and a box-like member extending from the bottom surface thereof in substantial vertical alignment with a top cutout in the top portion to cooperatively define the recessed cavity;

wherein the arm assembly is coupled to a bottom wall of the box-like member and comprises a central plate and a plurality of arms each having a first end portion pivotally connected to the central plate and a second end portion that slidably engages under retaining flanges of the main body when the container top is in the selective closed locked position and disengages therefrom to allow release of the container top;

wherein the shield comprises a top wall having a cam lock therethrough and joined to a pair of side flanges having a plurality of hooks extending downwardly therefrom, the shield in an engaged locked position when the plurality of hooks are slidably engaged into a plurality of slots in the bottom wall of the box-like member and the shield is fully received in the recessed cavity with the cam lock in a locked position.

10. The locking device of claim 9 wherein the main body is sized to be retained within a main cavity of the underground enclosure.

11. The locking device of claim 10 wherein both a pair of end walls and a pair of side walls having inwardly-extending retaining flanges along an upper edge thereof form the substantially box-shaped main body.

12. The locking device of claim 11 wherein cutouts are defined in at least one of the side walls and at least one of the end walls of the main body.

* * * * *